US008944572B2

(12) United States Patent
Ikeuchi et al.

(10) Patent No.: US 8,944,572 B2
(45) Date of Patent: Feb. 3, 2015

(54) LIQUID DISCHARGE HEAD AND RECORDING DEVICE USING SAME

(75) Inventors: Wataru Ikeuchi, Kirishima (JP); Daisuke Hozumi, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 14/128,584

(22) PCT Filed: Jun. 27, 2012

(86) PCT No.: PCT/JP2012/066398

§ 371 (c)(1),
(2), (4) Date: Dec. 20, 2013

(87) PCT Pub. No.: WO2013/002263

PCT Pub. Date: Jan. 3, 2013

(65) Prior Publication Data

US 2014/0125738 A1 May 8, 2014

(30) Foreign Application Priority Data

Jun. 28, 2011 (JP) ..... 2011-143108
Aug. 30, 2011 (JP) ..... 2011-187288
Oct. 31, 2011 (JP) ..... 2011-238964

(51) Int. Cl.
*B41J 2/045* (2006.01)
*B41J 2/14* (2006.01)
(Continued)

(52) U.S. Cl.
CPC .. *B41J 2/14* (2013.01); *B41J 2/055* (2013.01); *B41J 2/14209* (2013.01); *B05B 17/0646* (2013.01); *B41J 2002/14217* (2013.01);
(Continued)

(58) Field of Classification Search
CPC ..... B41J 2/14233; B41J 2002/14491; B41J 2/1623; B41J 2/161; B41J 2002/14419
See application file for complete search history.

(56) References Cited

U.S. PATENT DOCUMENTS

2005/0036013 A1 2/2005 Watanabe et al.
2006/0152555 A1 7/2006 Nakamura
(Continued)

FOREIGN PATENT DOCUMENTS

JP 2002234159 A 8/2002
JP 2003001823 A 1/2003
(Continued)

OTHER PUBLICATIONS

International Search Report, PCT/JP2012/066398, Aug. 7, 2012, 3 pp.

*Primary Examiner* — Lisa M Solomon
(74) *Attorney, Agent, or Firm* — Volpe and Koenig, P.C.

(57) ABSTRACT

A liquid ejecting head and a recording device are disclosed. The liquid ejecting head includes a fluid channel member and compressing members. The fluid channel member is elongated in a first direction. The fluid channel member includes ejection holes, compression chambers and a manifold. The compressing members is bonded to the fluid channel member. The manifold includes: a length extending in the first direction; openings at the first and second end portions of the fluid channel member; and secondary manifolds divided by one or more partitions that are elongated in the first direction. The compression chambers connected to one of the secondary manifolds configure two compression chamber rows disposed along the secondary manifolds, and the compression chambers belonging to the two compression chamber rows do not overlap in the first direction with compression chambers belonging to compression chamber rows adjacent to the two compression chamber rows.

18 Claims, 8 Drawing Sheets

(51) Int. Cl.
*B41J 2/055* (2006.01)
*B05B 17/00* (2006.01)

(52) U.S. Cl.
CPC ..... *B41J 2002/14225* (2013.01); *B41J 2002/14306* (2013.01); *B41J 2002/14419* (2013.01); *B41J 2002/14459* (2013.01)
USPC ..... 347/68

(56) References Cited

U.S. PATENT DOCUMENTS

2006/0284939 A1 12/2006 Katayama
2006/0284940 A1 12/2006 Katayama
2009/0244199 A1 10/2009 Watanabe
2009/0244211 A1 10/2009 Morita

FOREIGN PATENT DOCUMENTS

JP 2003305852 A 10/2003
JP 2004114477 A 4/2004
JP 2005059337 A 3/2005
JP 2006192583 A 7/2006
JP 2006347122 A 12/2006
JP 2006347123 A 12/2006
JP 2009234096 A 10/2009
JP 2009234143 A 10/2009

LIQUID DISCHARGE HEAD AND RECORDING DEVICE USING SAME

FIELD OF INVENTION

The present invention relates to a liquid ejecting head configured to eject a liquid, and a recording device that uses this liquid ejecting head.

BACKGROUND

In recent years, printing devices using inkjet recording methodologies such as inkjet printers and inkjet plotters are not only used in consumer-grade printers but are also widely used in manufacturing applications such as the forming of electrical circuits, the fabrication of color filters for liquid crystal displays, and the manufacture of organic EL displays.

These kinds of inkjet printing devices are provisioned with liquid ejecting heads configured to eject liquid as the printing head. The following are generally known as methodologies for these kinds of printing heads. One methodology is the thermal head type in which a heater functioning as a pressurizer is provisioned in an ink channel where the ink is filled. The ink is heated and boiled by the heater, then pressurized by air bubbles generated by the boiling of the ink in the ink channel, and ejected as droplets from the ink ejection hole. Another methodology is the piezoelectric type in which a portion of the walls of the ink channel where the ink is filled are made to flex by a displacing element, and this process mechanically pressurizes the ink in the ink channel to eject the ink as droplets from the ink ejection hole.

There are also the following methods in which these kinds of liquid ejecting heads are used to execute the recording. One is the serial method which executes the recording by moving the liquid ejecting head in a direction (primary scanning direction) orthogonal to the conveyance direction of the recording medium (secondary scanning direction). Another is the line method which executes the recording onto the recording medium conveyed in the secondary scanning direction, by a fixed liquid ejecting head which is longer in the primary scanning direction than the recording medium. The line method has an advantage of being capable of producing high-speed recordings as the liquid ejecting head does not need to be moved as with the serial method.

A well-known configuration of the liquid ejecting head long in one direction includes a laminating of a fluid channel member formed of multiple plates having been laminated, including a manifold functioning as a common channel and holes connected to the manifold via multiple compression chambers, and an actuator unit including multiple displacing elements provisioned to cover the compression chambers (refer to PTL 1 for example). The compression chambers connected to the multiple ejection holes are arranged in a matrix formation in this liquid ejecting head, and so ink is ejected from the ejection holes by causing displacing elements in the actuator unit configured to cover the compression chambers to displace, enabling printing in the primary scanning direction at a resolution of 600 dpi.

CITATION LIST

Patent Literature

PTL 1: Japanese Patent Application Publication No. 2003-305852

SUMMARY

Technical Problem

However, there are cases in which sufficient printing precision may not be obtained due to great influence of crosstalk between the displacing elements when attempting to increase the resolution using a configuration of the liquid ejecting head similar to that in PTL 1. Crosstalk can conceivably be reduced by increasing intervals between displacing element. However, increasing the intervals increases the width of the liquid ejecting head (size in the latitudinal direction), which has resulted in deterioration of printing precision.

Thus, the aim of the present invention is to provide a liquid ejecting head of which the latitudinal direction dimension can be reduced while minimizing crosstalk, and a recording device using this liquid ejecting head.

Solution to Problem

The liquid ejecting head according to the present invention includes: a fluid channel member long in one direction, including a plurality of ejection holes, a plurality of compression chambers connected to the plurality of ejection holes respectively, and a manifold to supply liquid to the plurality of compression chambers; and a plurality of compressing members bonded to the fluid channel member, to change the volume of the respective plurality of compression chambers. In planar view of the fluid channel member, the manifold extends from one end side of the fluid channel member to the other end side and is opened to the outside at both ends of the fluid channel member, and is partitioned into a plurality of secondary manifolds by one or more partitions long in the one direction. The compression chambers connected to one of the secondary manifolds form two compression chamber rows arrayed along the secondary manifold, and the compression chambers belonging to the two compression chamber rows do not overlap in the one direction with compression chambers belonging to compression chamber rows adjacent to the two compression chamber rows.

Also, a recording device according to the present invention includes: the liquid ejecting head; a conveying unit configured to convey a recording medium in relation to the liquid ejecting head; and a control unit configured to control the plurality of compressing members.

Advantageous Effects of Invention

According to the present invention, the latitudinal direction dimension of a liquid ejecting head can be reduced while minimizing the influence of crosstalk, so printing precision can be improved.

DETAILED DESCRIPTION OF THE PREFERRED EMBODIMENTS

Figure 1:
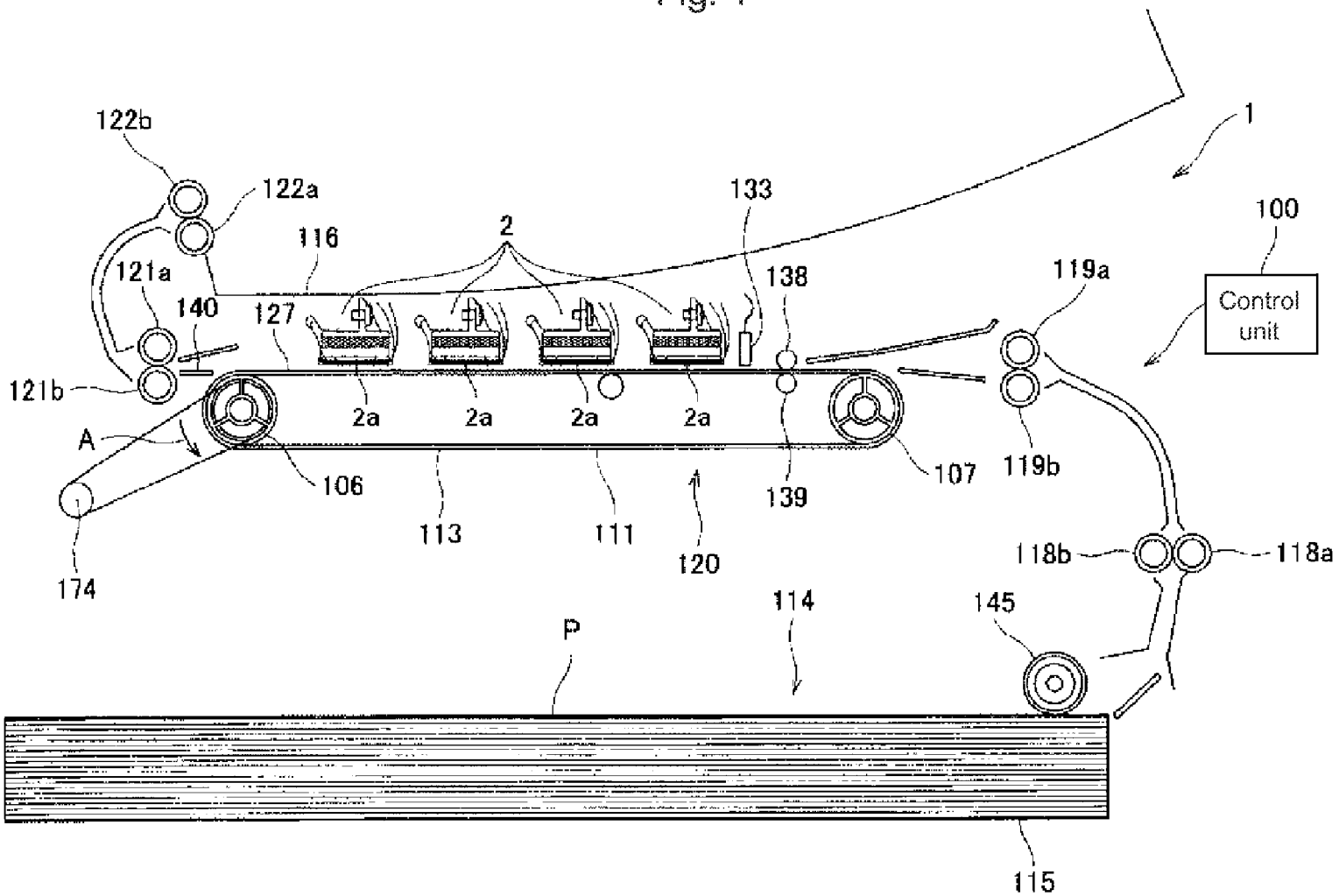
FIG. 1 is a diagram illustrating a summary configuration of a color inkjet printer functioning as a recording device which includes a liquid ejecting head according to an embodiment of the present invention.

FIG. 1 is a diagram illustrating a summary configuration of a color inkjet printer functioning as a recording device which includes a liquid ejecting head according to an embodiment of the present invention. This color inkjet printer 1 (hereafter, referred to as printer 1) includes four liquid ejecting heads 2. These liquid ejecting heads 2 are lined along the conveyance direction of a printing paper P, and are fixed to the printer 1. The liquid ejecting heads 2 have a long and narrow rectangular form in the direction from the near side toward the far side as in FIG. 1. This length direction may also be called the longitudinal direction.

The printer 1 is provisioned with a paper feed unit 114, a conveying unit 120, and a paper receiving unit 116 in this order along the conveyance path of the printing paper P. The printer 1 is also provisioned with a control unit 100 to control the operations of the various components of the printer 1 such as the liquid ejecting head 2 and the paper feed unit 114.

The paper feed unit 114 includes a paper storage case 115 capable of storing multiple sheets of the printing paper P, and a paper feed roller 145. The paper feed roller 145 feeds the top-most sheet of printing paper P one sheet at a time from the stack of the printing paper P stored in the paper storage case 115.

A pair of feed rollers 118*a* and 118*b* and a pair of feed rollers 119*a* and 119*b* are arranged between the paper feed unit 114 and the conveying unit 120 along the conveyance path of the printing paper P. The printing paper P conveyed from the paper feed unit 114 is guided by these feed rollers to the conveying unit 120.

The conveying unit 120 includes an endless conveying belt 111 and two belt rollers 106 and 107. The conveying belt 111 is looped around the belt rollers 106 and 107. The length of the conveying belt 111 is adjusted so that the belt retains a predetermined amount of tension when looped around the two belt rollers. As a result, the conveying belt 111 is tautened without having any slack along two parallel planes which are common tangents of the two belt rollers. The closer of these two planes to the liquid ejecting head 2 is a conveying plane 127 that conveys the printing paper P.

A conveying motor 174 is connected to the belt roller 106 as illustrated in FIG. 1. The conveying motor 174 rotates the belt roller 106 in the direction indicated by the arrow A. The belt roller 107 is rotated by the movement of the conveying belt 111. Therefore, the conveying belt 111 moves along the direction indicated by the arrow A by the drive force generated by the conveying motor 174 to rotate the belt roller 106.

A nip roller 138 and a nip receiving roller 139 are in an arrangement sandwiching the conveying belt 111 near the belt roller 107. The nip roller 138 is biased downwards by a spring not illustrated. The nip receiving roller 139, which is below the nip roller 138, accepts the nip roller 138 biased downwards via the conveying belt 111. The two nip rollers are provisioned to be rotatable, and so rotate by the movement of the conveying belt 111.

The printing paper P fed from the paper feed unit 114 to the conveying unit 120 is sandwiched between the nip roller 138 and the conveying belt 111. As a result, the printing paper P is pushed against the conveying plane 127 of the conveying belt 111 to be adhered on top of the conveying plane 127. The printing paper P is then conveyed by the rotation of the conveying belt 111 in the direction where the liquid ejecting head 2 is arranged. An outer surface 113 of the conveying belt 111 may also be processed with silicone rubber having adhesive properties. As a result, the printing paper P may be reliably anchored to the conveying plane 127.

The liquid ejecting head 2 includes a head body 2*a* on the lower end. The lower surface of the head body 2*a* forms a ejection hole surface 4-1 provisioned to multiple ejection holes for ejecting liquid.

Liquid (ink) of the same color is ejected from a liquid ejection hole 8 provisioned to one liquid ejecting head 2. The liquid is supplied from an external liquid tank, which is not illustrated, to the liquid ejecting heads 2. The liquid ejection holes 8 in each liquid ejecting head 2 open to the liquid ejection hole surface and are arranged at equal intervals along a singular direction (the longitudinal direction of the liquid ejecting head 2, which is the direction that is perpendicular to the conveyance direction of the printing paper P and parallel with the printing paper P). This enables printing without any gaps along the singular direction. The color of the liquid ejected from each liquid ejecting head 2 is, for example, magenta (M), yellow (Y), cyan (C), and black (K). Each liquid ejecting head 2 is arranged having a slight space between the lower surface of a liquid ejecting head body 13 and the conveying plane 127 of the conveying belt 111.

The printing paper P which is conveyed by the conveying belt 111 moves in the space between the liquid ejecting head 2 and the conveying belt 111. During this process, droplets are ejected onto the top surface of the printing paper P from the head body 2*a* configuring the liquid ejecting head 2. As a result, a color image based on image data stored by the control unit 100 is formed onto the top surface of the printing paper P.

A separating plate 140, a pair of feed rollers 121*a* and 121*b*, and a pair of feed rollers 122*a* and 122*b* are arranged between the conveying unit 120 and the paper receiving unit 116. The printing paper P to which the color image is printed is conveyed to the separating plate 140 by the conveying belt 111. The printing paper P is separated from the conveying plane 127 at this point by the right edge of the separating plate 140. Then, the printing paper P is conveyed to the paper receiving unit 116 by the feed rollers 121*a* through 122*b*. In this way, the printed printing paper P is conveyed sequentially to and stacked in the paper receiving unit 116.

A paper surface sensor 133 is arranged between the nip roller 138 and the liquid ejecting head 2 which is the furthest upstream in the conveyance direction of the printing paper P. The paper surface sensor 133 is configured with light-emitting elements and photoreceptor elements to detect the leading edge position of the printing paper P on the conveyance path. The detection result from the paper surface sensor 133 is sent to the control unit 100. The control unit 100 may control the liquid ejecting head 2 and the conveying motor 174 so that the conveyance of the printing paper P synchronizes with the image to be printed on the basis of the detection result sent from the paper surface sensor 133.

Figure 2:
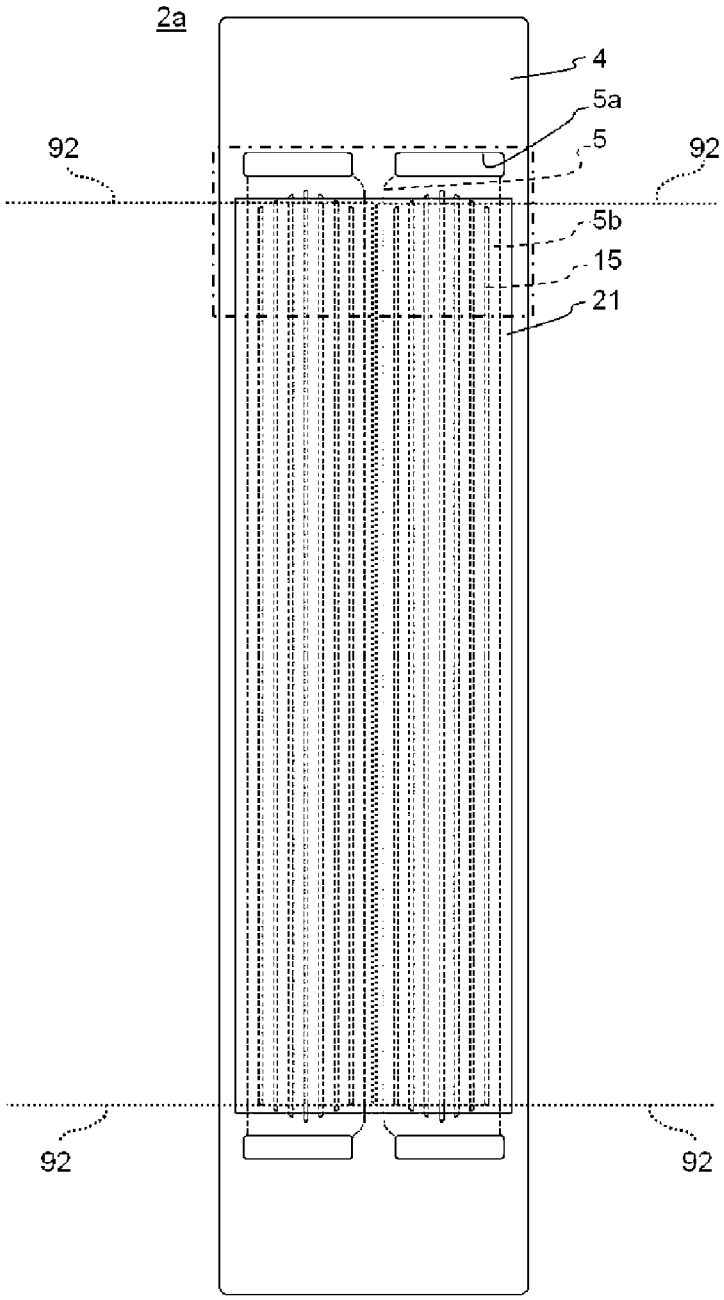
FIG. 2 is a plan view of a fluid channel member and a piezoelectric actuator configuring the liquid ejecting head in FIG. 1.
Figure 3:
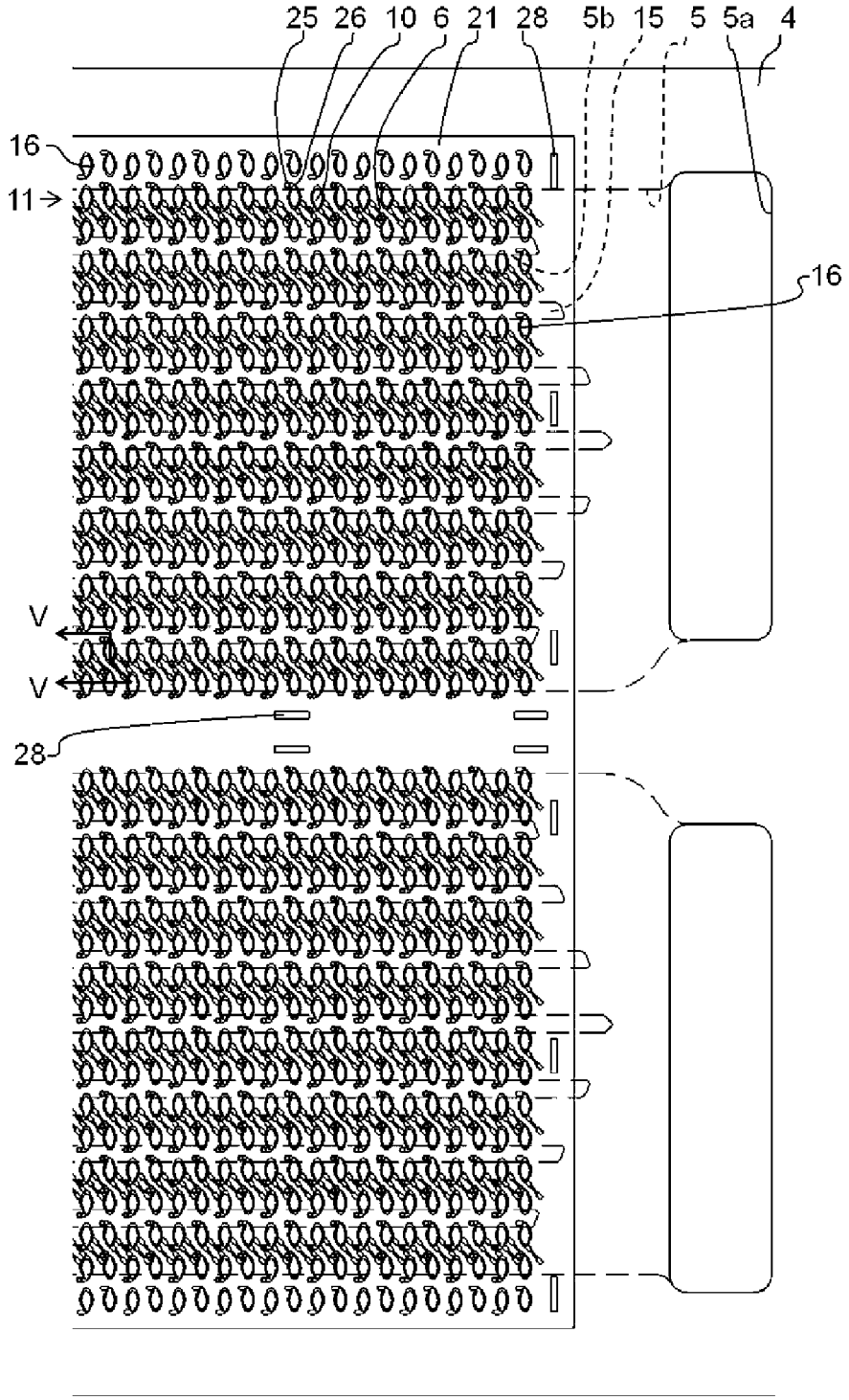
FIG. 3 is an enlarged view of the region in FIG. 2 enclosed in a dotted line, in which a portion of the channel is omitted to simplify the description.
Figure 4:
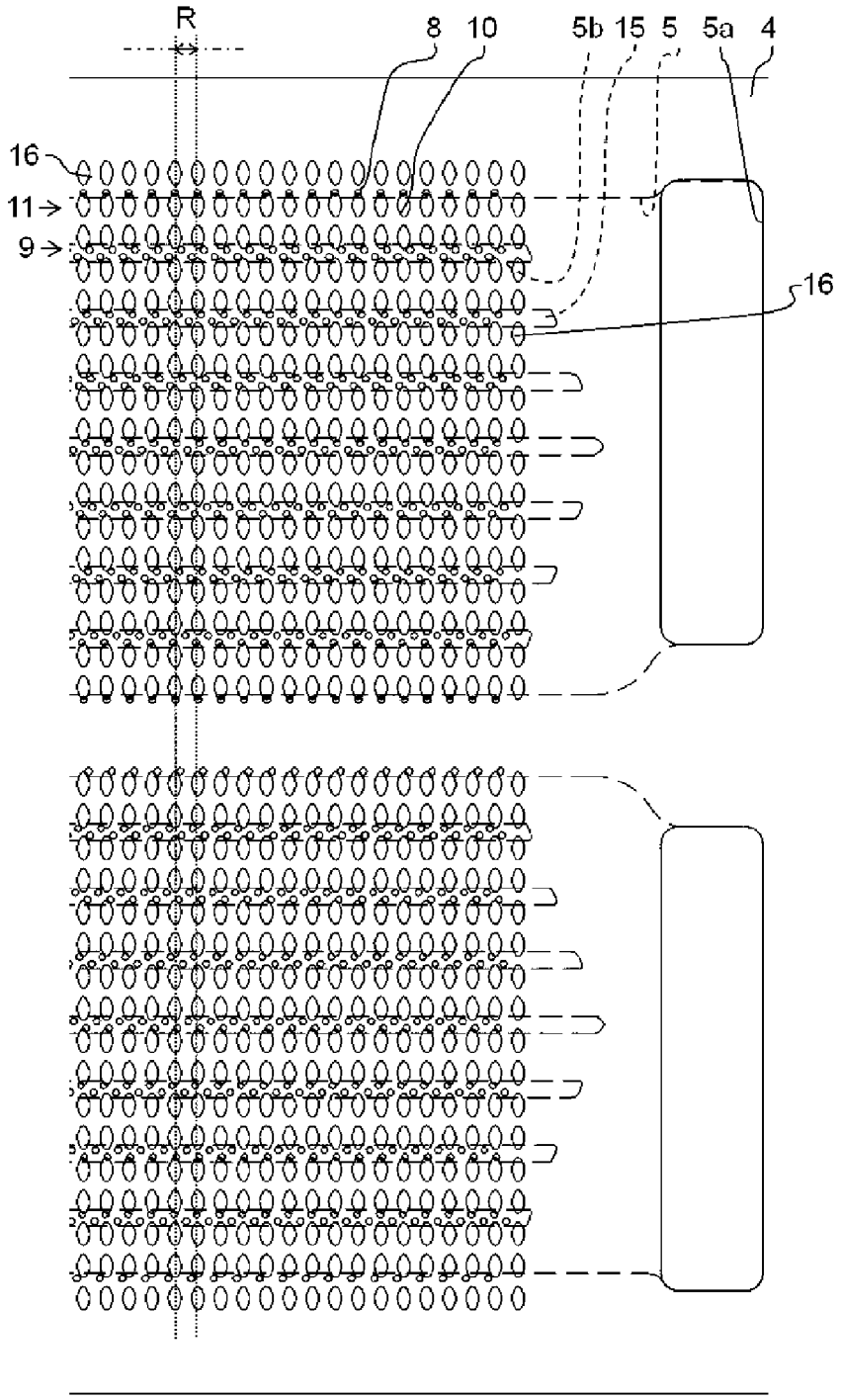
FIG. 4 is another enlarged view of the region in FIG. 2 enclosed in a dotted line, in which a portion of the channel is omitted to simplify the description.
Figure 5:
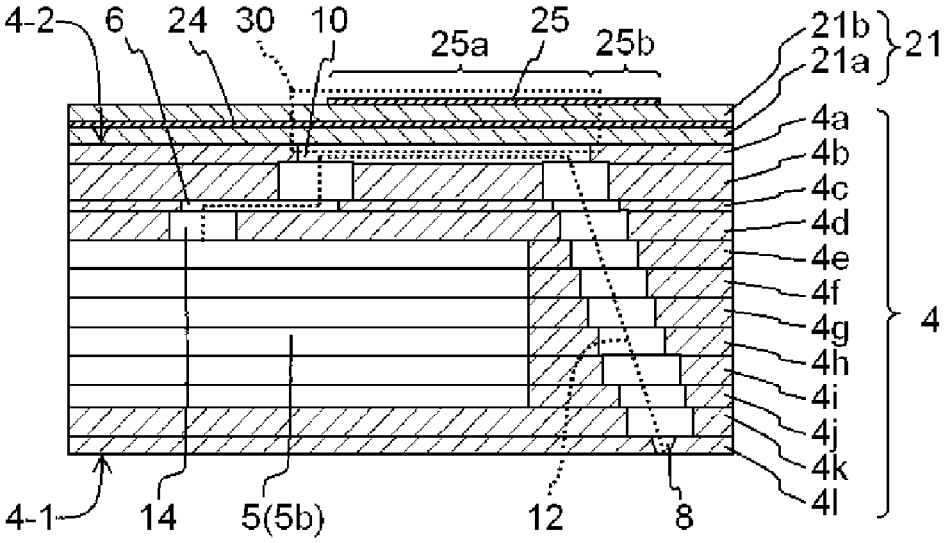
FIG. 5 is a longitudinal-sectional diagram along the line V-V in FIG. 3.
Figure 6:
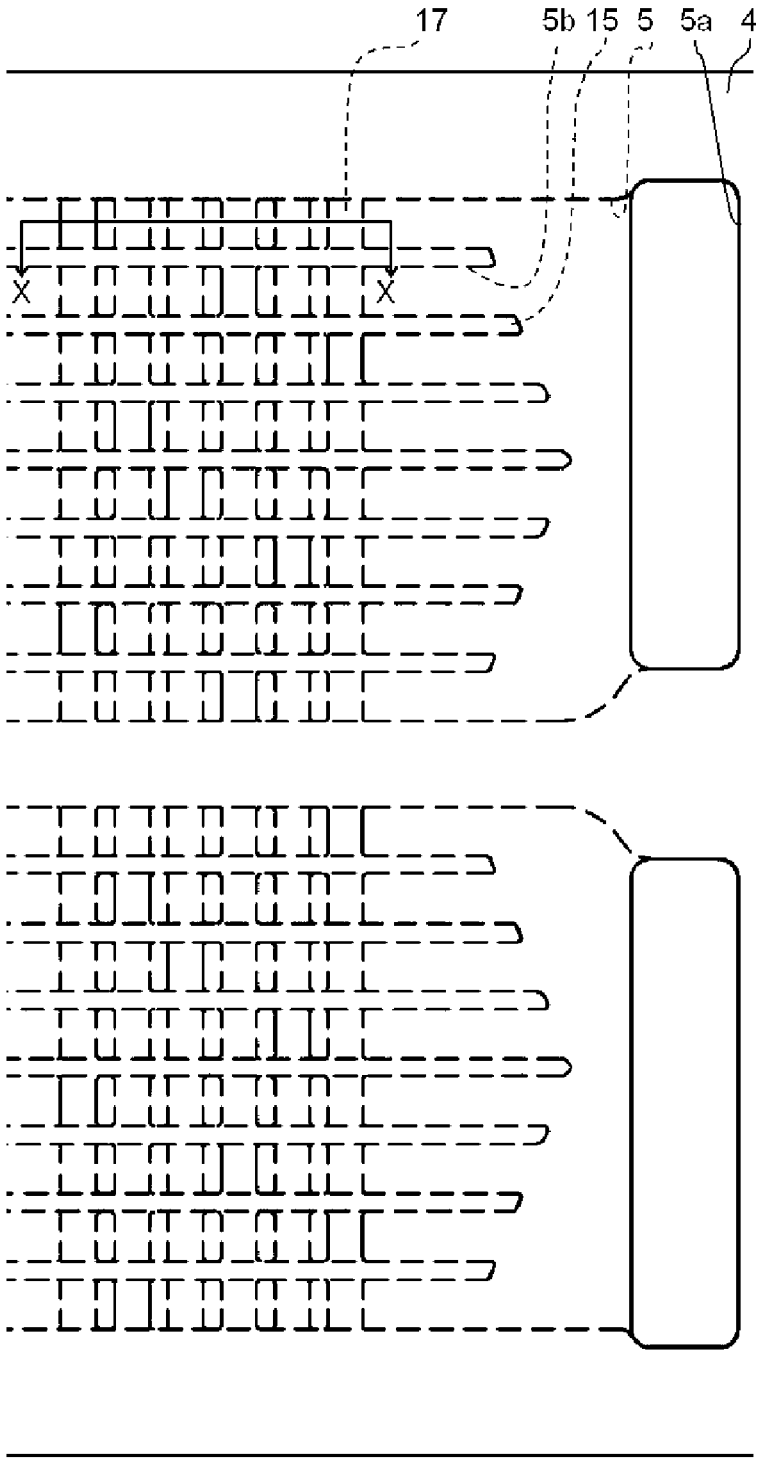
FIG. 6 is an enlarged view of the region in FIG. 2 enclosed in a dotted line, in which a portion of the channel is omitted to simplify the description.

Next, the liquid ejecting head 2 according to the present invention will be described. FIG. 2 is a plan view of the head body 2*a*. FIG. 3 is an enlarged view of the region in FIG. 2 enclosed in a dotted line, and is a plan view in which a portion of the channel is removed to simplify the description. FIG. 4 and FIG. 6 are enlarged views of the region in FIG. 2 enclosed in a dotted line, in which a portion of the channel different from that of FIG. 3 is removed to simplify the description. A diaphragm 6, the ejection hole 8, and a compression chamber 10 under a piezoelectric actuator substrate 21 are drawn with solid lines instead of dashed lines which they should be drawn with, for the sake of clarity in FIG. 3, FIG. 4, and FIG. 6. FIG. 5 is a longitudinal-sectional diagram along the line V-V in FIG. 3. The ejection hole 8 in FIG. 4 is drawn with a diameter larger than its actual diameter to help clarify its position.

The liquid ejecting head 2 includes a reservoir and a metal chassis in addition to the head body 2*a*. Also, the head body 2*a* includes a fluid channel member 4 and the piezoelectric actuator substrate 21 which is made with a displacing element (compressing member) 30.

The fluid channel member 4 configuring the head body 2*a* is provisioned with a manifold 5 which is a common channel, multiple units of the compression chamber 10 connected to the manifold 5, and multiple units of the ejection hole 8 connected to the multiple units of the compression chamber 10. The compression chamber 10 opens to the top surface of the fluid channel member 4, and the top surface of the fluid channel member 4 forms a compression chamber surface 4-2. The top surface of the fluid channel member 4 includes a hole 5*a* connected to the manifold 5, and liquid is supplied by this hole 5*a*.

The piezoelectric actuator substrate 21 including the displacing element 30 is attached to the top surface of the fluid channel member 4, and each displacing element 30 is arranged so as to be positioned over the compression chamber 10. A signal transmission unit 92 such as a FPC (Flexible Printed Circuit) to supply signals to each displacing element 30 is connected to the piezoelectric actuator substrate 21. The dotted line in FIG. 2 represents the outline near the connection of the signal transmission unit 92 with the piezoelectric actuator 21 to illustrate that two units of the signal transmission unit 92 are connected to the piezoelectric actuator substrate 21. An electrode on the signal transmission unit 92, electrically connected to the piezoelectric actuator substrate 21, is arranged on the end of the signal transmission unit 92, having a rectangular form. The two units of signal transmission unit 92 are connected so that the ends are directed toward the center of the piezoelectric actuator substrate 21 in the latitudinal direction. The two units of the signal transmission unit 92 extend along the long side of the piezoelectric actuator substrate 21 from the center.

A driver IC is implemented to the signal transmission unit 92. The driver IC is implemented so as to push against the metal chassis so that the heat generated by the driver IC is radiated external through the metal chassis. The drive signal for activating the displacing element 30 on the piezoelectric actuator substrate 21 is generated within the driver IC. The signal for controlling generating of the drive signal is generated by the control unit 100, and is input from the end opposite the side connecting the signal transmission unit 92 and the piezoelectric actuator substrate 21. A circuit board may be provisioned as necessary in the liquid ejecting head 2 between the control unit 100 and the signal transmission unit 92.

The head body 2*a* includes the fluid channel member 4 having a plane form, and one piezoelectric actuator substrate 21 including the displacing element 30 connected on top of the fluid channel member 4. The plane form of the piezoelectric actuator substrate 21 is rectangular, and is arranged on the top surface of the fluid channel member 4 so that the long side of this rectangular form lines up with the longitudinal direction of the fluid channel member 4.

Two units of the manifold 5 are formed in the interior of the fluid channel member 4. The manifold 5 has a long and narrow form extending from one end of the fluid channel member 4 in the longitudinal direction to the other end. A hole 5*a* of the manifold is formed at each end thereof, opening to the top surface of the fluid channel member 4. Supply shortages of the liquid are mostly avoided by supplying liquid to the fluid channel member 4 from both ends of the manifold 5. This configuration may also minimize variances in liquid eject performance as the difference in stress losses generated when liquid flows from the manifold 5 is reduced by approximately one-half as compared to configuration in which liquid is supplied from only one end of the manifold 5. Further, arrangements may be conceived where liquid is supplied around the middle of the manifold 5 or from several places along the manifold 5, in order to reduce difference in stress losses. However, such structures would increase the width of the liquid ejecting head 2, and the ejection holes 8 would be disposed over a greater area in the width direction of the liquid ejecting head 2. Such an arrangement is undesirable, since the effects of angular deviation of attachment of the liquid ejecting head 2 to the printer 1 on printing results are great. Similarly, in a case where multiple liquid ejecting heads 2 are used to print, the area over which the overall ejection holes 8 of the multiple liquid ejecting heads 2 are disposed is greater, so the effects that the precision of relative position of the multiple liquid ejecting heads 2 have on the printing results is great, which is undesirable. Accordingly, liquid is preferably supplied from both ends of the manifold 5 to reduce difference in stress losses while reducing the width of the liquid ejecting head 2.

The center of the manifold 5 in the length direction, which is the region connected to at least the compression chamber 10, is separated by a partition 15 provisioned to widen a space in the latitudinal direction. The partition 15 has the same height as the manifold 5 at the center in the length direction, which is the region connected to the compression chamber 10, and completely separates the manifold 5 from multiple units of a secondary manifold 5*b*. In this way, a descender connected to the ejection hole 8 and the compression chamber 10 from the ejection hole 8 may be provisioned to overlap the partition 15 when seen from the plan view.

All of the manifold 5 in FIG. 2 is separated by the partition 15, except for the two ends. In addition to this configuration, the partition 15 may also separate one of the ends. A partition may also be provisioned from the hole 5*a* toward the depth direction of the fluid channel member 4 so that the area near the hole 5*a* hole the top surface of the fluid channel member 4 is not the only area separated. However, channel resistance is reduced by the portions not separated, which increases the amount of liquid supplied, so it is preferable that both ends of the manifold 5 are not separated by the partition 15. Such an embodiment will be described later in further detail.

The portions of the manifold 5 that are divided into multiple units are referred to as the secondary manifold 5*b*. According to the present embodiment, the manifold 5 is provisioned as two independent units, and the hole 5*a* is provisioned on both ends of each of these units. Seven units of the partition 15 are provisioned to one manifold 5, and so divided into eight units of the secondary manifold 5*b*. The width of the secondary manifold 5*b* is wider than the width of the partition 15, which enables a significant amount of liquid to flow to the secondary manifold 5*b*. The seven units of the partition 15 become increasingly longer the closer they are to the center in the latitudinal direction. Regarding both ends of the manifold 5, the ends of the partition 15 become increasingly closer to the ends of the manifold 5 the closer each partition 15 is to the center in the latitudinal direction. As a result, a balance is established between the channel resistance generated by the walls external to the manifold 5 and the channel resistance generated by the partition 15, and so the stress differences may be reduced in the liquid at the end of a region formed by an independent supply channel 14, which is the secondary manifold 5*b* connected to the compression chamber 10. The stress difference at this independent supply channel 14 has a relationship with the stress difference added to the liquid in the compression chamber 10, and so variances in ejects may be reduced by reducing the stress differences in the independent supply channel 14.

Supporting members 17 are provisioned in the secondary manifold 5*b*, traversing in the width direction. The supporting members 17 either connect adjacent partitions 15 or connect a partition 15 at the very edge with a wall of the manifold 5. The fluid channel member 4 has a structure of plates 4*a* through 4*l* having flat shapes which have been laminated, which will be described later in detail. In the fabrication process, the supporting members 17 support partitioning portions which are the partitions 15. This structure allows the fluid channel member 4 with the channels formed within to be fabricated simply by laminating the plates 4*a* through 4*l*. The partitioning portions will fall off of the plates without the supporting members 17 in the present embodiment. Also, the partitioning portions will not fall off of the plates if the configuration is such that the ends thereof in the length direction are connected to the plates, but the laminated partitioning portions to become the partitions 15 partitioning the secondary manifold 5*b* which is long in one direction will easily shift in the width direction without the supporting members 17. Accordingly, provisioning the supporting members 17 so as to traverse the secondary manifold 5*b* in the width direction allows the fabrication precision of the channels to be improved.

The fluid channel member 4 is formed with multiple units of the compression chamber 10 spread out two dimensionally. The compression chamber 10 is a hollow region having a plane form in a near-diamond shape formed, with the corner portions rounded.

The compression chamber 10 is connected to one secondary manifold 5*b* via the independent supply channel 14. A compression chamber row 11, which is a row of multiple units of the compression chamber 10 connected to this secondary manifold 5*b*, is arranged to line up with the secondary manifold 5*b*. A total of two rows of the compression chamber row 11 are provisioned to one secondary manifold 5*b* with one row on each end of the secondary manifold 5*b*. Therefore, there are 16 rows of the compression chamber 11 provisioned for one manifold 5, which equates to 32 rows of the compression chamber row 11 in total for the head body 2*a*. The spacing between each compression chamber 10 in the longitudinal direction of the compression chamber row 11 is the same distance, which as an example may be 37.5 dpi.

A dummy compression chamber 16 is provisioned to the end of each compression chamber row 11. This dummy compression chamber 16 is connected to the manifold 5, but is not connected to the ejection hole 8. A dummy chamber row is provisioned on the outer side of the 32 rows of the compression chamber row 11 forming a straight line of multiple units of the dummy compression chamber 16. These units of the dummy compression chamber 16 are neither connected to the manifold 5 nor the ejection hole 8. These dummy compression chambers enable differences in liquid ejecting performance to be reduced as the construction (stiffness) of the perimeter around the first inner compression chamber 10 from the end is closer to the construction (stiffness) of other units of the compression chamber 10. The effect of the difference in the construction of the perimeter produced by the units of the compression chamber 10 which are finely spaced apart and adjacent in the longitudinal direction is significant, and so this is why the dummy compression chambers are provisioned on both ends in the longitudinal direction. The effect is relatively insignificant regarding the latitudinal direction, and so the dummy compression chamber is only provisioned to the end near a head body 21*a*. As a result, the width of the head body 21*a* may be reduced.

The units of the compression chamber 10 connected to one manifold 5 are arranged on a grid having rows and columns following the outer edges of the rectangular piezoelectric actuator substrate 21. Accordingly, the independent electrodes 25 formed on the compression chamber 10 are disposed in an equidistant manner from the outer edges of the piezoelectric actuator substrate 21, so the piezoelectric actuator substrate 21 deforms less readily when forming the independent electrodes 25. When the piezoelectric actuator substrate 21 and the fluid channel member 4 are bonded, stress is applied to the displacing element 30 close to the outer edge when this deformation is significant, which may cause variances in deformation performance, but these variances may be reduced by reducing the deformation. The effect of deformations is further mitigated by the provisioning of the dummy compression chamber row of the dummy compression chamber 16 at the outer edge of the compression chamber row 11 closest to the outer edge. The units of the compression chamber 10 belonging to the compression chamber row 11 are arranged at even spacings, and the units of the independent electrode 25 corresponding to the compression chamber row 11 are also arranged at even spacings. The compression chamber row 11 is arranged at even spacings in the latitudinal direction, and the column of the independent electrode 25 corresponding to the compression chamber row 11 is arranged at even spacings in the latitudinal direction. As a result, regions where the effect of crosstalk is particularly significant may be removed.

The compression chambers 10 are disposed in a grid form in the present embodiment, but may be disposed in a staggered form so as to form angles with the units of the compression chamber 10 belonging to the adjacent compression chamber row 11. Thus, the distance to the units of the compression chamber 10 belonging to the adjacent compression chamber row 11 is longer, so crosstalk can be further suppressed.

When viewing the fluid channel member 4 from a plan view, the units of the compression chamber 10 belonging to one compression chamber row 11 and the units of the compression chamber 10 belonging to the adjacent compression chamber row 11 are arranged not to overlap in the longitudinal direction of the liquid ejecting head 2, regardless of how the compression chamber rows 11 are arrayed, which may suppress crosstalk. Conversely, if the compression chamber row 11 is separated by a distance, the width of the liquid ejecting head 2 increases, and so the precision of the arrangement angles of the liquid ejecting head 2 in correspondence with the printer 1 and the precision of the relative positions of the liquid ejecting head 2 when using multiple units of the liquid ejecting head 2 has a significant effect on the printing result. This effect of these precision issues on the printing result may be reduced by making the width of the partition 15 smaller than the secondary manifold 5*b*.

The units of the compression chamber 10 connected to one secondary manifold 5*b* form two rows of the compression chamber row 11, and the units of the ejection hole 8 connecting from the units of the compression chamber 10 belonging to the one compression chamber row 11 form one ejection hole row 9. The units of the ejection hole 8 connected to the units of the compression chamber 10 belonging to the two rows of the compression chamber row 11 open to different sides of the secondary manifold 5*b*. Two rows of the ejection hole row 9 are provisioned on the partition 15 as in FIG. 4, but the units of the ejection hole 8 belonging to the rows of the ejection hole row 9 are connected to the side of the secondary manifold 5*b* near the ejection hole 8 via the compression chamber 10. Crosstalk is further reduced by suppressing crosstalk between channels connecting the compression chamber 10 and the ejection hole 8 with the arrangement of the units of the ejection hole 8, which are connected to the adjacent secondary manifold 5*b* via the compression chamber row 11, not overlapping in the longitudinal direction of the liquid ejecting head 2. Crosstalk may be further reduced by arranging the entire channel connecting the compression chamber 10 and the ejection hole 8 so as to not overlap in the longitudinal direction of the liquid ejecting head 2.

The width of the liquid ejecting head 2 may be reduced by arranging the compression chamber 10 and the secondary manifold 5*b* to overlap in the plan view. The width of the liquid ejecting head 2 may be further reduced by increasing the ratio of area overlapping the area of the compression chamber 10 to 80% or more, and further to 90% or more. The stiffness of the bottom surface of the compression chamber 10 of the portion that is overlapping with the secondary manifold 5*b* is lower in comparison when not overlapping with the secondary manifold 5*b*, and this difference may cause variances in the ejecting performance. The variances in the ejecting performance caused by different levels of stiffness in the bottom surface configuring the compression chamber 10 may be reduced by having nearly the same ratio corresponding to the total area of the area of the compression chamber 10 that overlaps with the secondary manifold 5*b* for each unit of the compression chamber 10. Nearly the same ratio here refers to a difference in the ratio of area of no more than 10%, and preferably, no more than 5%.

A group of compression chambers is configured by the multiple units of the compression chamber 10 connected to one manifold 5, and so there are two compression chamber groups as there are two units of the manifold 5. The arrangement of the units of the compression chamber 10 involved in the ejection within each compression chamber group is the same and is located shifted in parallel in the latitudinal direction. These units of the compression chamber 10 are arranged over nearly the entire surface of the region corresponding to the piezoelectric actuator substrate 21, which is on the top surface of the fluid channel member 4 even though there is a portion in which spacings such as those between the compression chamber groups are widened. That is to say, the compression chamber group formed with the units of the compression chamber 10 occupies a region of nearly the same size and form as the piezoelectric actuator substrate 21. The holes of each compression chamber 10 are closed by the joining of the piezoelectric actuator substrate 21 to the top surface of the fluid channel member 4.

A descender connected to the ejection hole 8 which opens to a ejection hole surface 4-1 on the lower surface of the fluid channel member 4 extends from the angle portion opposing the angle portion connecting with the independent supply channel 14 of the compression chamber 10. The descender extends in the direction away from the compression chamber 10 when viewing from the plan view. Specifically, the descender extends away from the direction along the long diagonal of the compression chamber 10 while shifting in the right and left of this direction. As a result, the ejection hole 8 may be arranged at spacings resulting in a total resolution of 1200 dpi while the compression chamber 10 is arranged in a grid pattern with their spacings within the compression chamber rows 11 set to 37.5 dpi.

To word this differently, if the ejection hole 8 is projected to intersect an imaginary straight line running parallel with the longitudinal direction of the fluid channel member 4, then the 32 units of the ejection hole 8 as the total of 16 units of the ejection hole 8 connected to each manifold 5 have even spacings of 1200 dpi in the range defined by the R of the imaginary straight line illustrated in FIG. 4. As a result, an image may be formed in its entirety at a resolution of 1200 dpi in the longitudinal direction by supplying ink of the same color to all units of the manifold 5. One unit of the ejection hole 8 connected to one manifold 5 has an even spacing of 600 dpi in the range defined by the R of the imaginary straight line. As a result, an image of two colors may be formed in its entirety at a resolution of 600 dpi in the longitudinal direction by supplying ink of different colors to each manifold 5. In this case, using two units of the liquid ejecting head 2 enables an image of four colors to be formed at a resolution of 600 dpi, which increases the printing accuracy and enables simple printing settings in comparison with using a liquid ejecting head capable of printing at 600 dpi.

A reservoir may connected to the fluid channel member 4 in the liquid ejecting head 2 to stabilize the supply of liquid from the hole 5*a* in the manifold. Provisioning two channels connected to the hole 5*a* to bifurcate the liquid supplied externally enables the liquid to be supplied to the two holes in a stable manner. Variances in the ejecting performance of droplets from the liquid ejecting head 2 may be further reduced by an equal length of the channels from the bifurcation as changes in temperature and stress in the liquid supplied externally is then transferred to the hole 5*a* at both ends of the manifold 5 with little difference in time. The provisioning of a damper in the reservoir may further stabilize the supply of liquid. A filter may also be provisioned to suppress impurities and such in the liquid from flowing toward the fluid channel member 4. A heater may also be provisioned to stabilize the temperature of the liquid flowing toward the fluid channel member 4.

The independent electrode 25 is formed on the top surface of the piezoelectric actuator substrate 21 at positions facing to each compression chamber 10. The independent electrode 25 is somewhat smaller than the compression chamber 10, and includes an independent electrode body 25*a* having a form nearly identical to the compression chamber 10 and a lead-out electrode 25*b* led out from the independent electrode body 25*a*. The independent electrode 25 configures independent electrode rows and independent electrode groups in the same way as the compression chamber 10. A common-electrode surface electrode 28 electrically connected to a common electrode 24, via a via hole, is formed on the top surface of the piezoelectric actuator substrate 21. Two rows of the common-electrode surface electrode 28 are formed along the longitudinal direction in the center of the piezoelectric actuator substrate 21 in the latitudinal direction, and one row of the common-electrode surface electrode 28 is formed along the latitudinal direction near the end in the longitudinal direction. The illustrated common-electrode surface electrode 28 is formed intermittently on a straight line, but may be formed consecutively on a straight line.

The piezoelectric actuator substrate 21 is preferably laminated with a piezoelectric ceramic layer 21*a* forming the via hole described later, the common electrode 24, and a piezoelectric ceramic layer 21*b*, and then the independent electrode 25 and the common-electrode surface electrode 28 are formed together during the same process after the firing. If the piezoelectric actuator substrate 21 is fired after the independent electrode 25 is formed, the piezoelectric actuator substrate 21 may warp. Stress is applied to the piezoelectric actuator substrate 21 when a warped piezoelectric actuator substrate 21 is bonded to the fluid channel member 4. Because of this and the significant effect on ejecting performance caused by variances in the positioning of the independent electrode 25 and the compression chamber 10, the independent electrode 25 is formed after the firing. The independent electrode 25 and the common-electrode surface electrode 28 are formed together during the same process as the common-electrode surface electrode 28. The reasons are that the common-electrode surface electrode 28 may also exhibit warpage, and that forming the common-electrode surface electrode 28 together with the independent electrode 25 at the same time improves positional accuracy and simplifies the forming process.

Variances in the position of the via hole may be caused by shrinkage during the firing of the piezoelectric actuator substrate 21. These variances mainly occur in the longitudinal direction of the piezoelectric actuator substrate 21, and may separate the electrical connection between the via hole and the common-electrode surface electrode 28 due to positional offset therebetween. This may be circumvented by provisioning the common-electrode surface electrode 28 in the center of the even number of units of the manifold 5 in the latitudinal direction and by forming the common-electrode surface electrode 28 with a long form in the longitudinal direction of the piezoelectric actuator substrate 21.

Two units of the signal transmission unit 92 are bonded to the piezoelectric actuator substrate 21 in an arrangement from the two long edges of the piezoelectric actuator substrate 21 toward the center. Connections may be readily performed at this time by forming and connecting a connecting electrode 26 and a common-electrode connecting electrode on the lead-out electrode 25*b* of the piezoelectric actuator substrate 21*a* and the common-electrode surface electrode 28. If the area of the common-electrode surface electrode 28 and the common-electrode connecting electrode is made larger than the area of the connecting electrode 26 at this time, the connecting at the end of the signal transmission unit 92 (the leading end and the end in the longitudinal direction of the piezoelectric actuator substrate 21) may be made stronger than the connections to the common-electrode surface electrode 28, which helps prevent peeling of the signal transmission unit 92 from the end.

The ejection hole 8 is arranged in a position avoiding the region facing the manifold 5, which is arranged to the lower surface of the fluid channel member 4. The ejection hole 8 is arranged in the region facing the piezoelectric actuator substrate 21 regarding the lower surface of the fluid channel member 4. These units of the ejection hole 8 form a group occupying a region having nearly the same size and form as the piezoelectric actuator substrate 21. Droplets are ejected from the ejection hole 8 by the displacement caused by the displacing element 30 on the corresponding piezoelectric actuator substrate 21.

The fluid channel member 4 included in the head body 2*a* has a laminated construction of multiple layers of plates. In order from the top surface of the fluid channel member 4, these plates include a cavity plate 4*a*, a base plate 4*b*, an aperture (diaphragm) plate 4*c*, a supply plate 4*d*, manifold plates 4*e* through 4*j*, a cover plate 4*k*, and a nozzle plate 4*l*. Multiple holes are formed in these plates. Configuring the thickness of each plate at range between 10 to 300 μm improves the precision when forming the holes. Each plate is positioned and laminated so that the holes connect to configure an independent channel 12 and the manifold 5. The head body 2*a* is configured so that the compression chamber 10 is arranged to the upper surface of the fluid channel member 4, the manifold 5 to the lower surface within the fluid channel member 4, and the ejection hole 8 to the lower surface in which each portion configuring the independent channel 12 is arranged adjacent to each other at different positions, which connects the manifold 5 and the ejection hole 8 via the compression chamber 10.

The holes formed on each plate will be described, which include the following types. A first hole is the compression chamber 10 formed in the cavity plate 4*a*. A second hole is a communication hole configuring the independent supply channel 14 connecting to the manifold 5 from one end of the compression chamber 10. This communication hole is formed on each plate from the base plate 4*b* (specifically, the entrance of the compression chamber 10) to the supply plate 4*c* (specifically, the exit of the manifold 5). The independent supply channel 14 includes the diaphragm 6, which is the area of the channel with a smaller cross-sectional area formed in the aperture plate 4*c*.

A third hole is a communication hole configuring the channel passing from one end of the compression chamber 10 to the ejection hole 8, and this communication hole is referred to as the descender (portional channel) described later. The descender is formed on each plate from the base plate 4*b* (specifically, the exit of the compression chamber 10) to the nozzle plate 4*l* (specifically, the ejection hole 8). The hole in the nozzle plate 4*l* functions as the ejection hole 8 having a diameter between 10 to 40 μm, for example, that opens to the outside of the fluid channel member 4, increasing in diameter toward the inside. A fourth hole is a via hole configuring the manifold 5. This via hole is formed on the manifold plates 4*e* through 4*j*. The holes are formed on the manifold plates 4*e* through 4*j* so that the partition portion to become the partition 15 remains so as to configure the secondary manifold 5*b*. The partition portion regarding each manifold plate 4*e* through 4*j* is connected to each manifold plate 4*e* through 4*j* by a half-etched supporting member 17. Placement and the like of the supporting members 17 will be described later. The first through fourth via holes are mutually connected, and configure the independent channel 12 extending from the inlet for the liquid from the manifold 5 (exit of the manifold 5) to the ejection hole 8. The liquid supplied to the manifold 5 is ejected from the ejection hole 8 through the following path. First, the liquid travels upward from the manifold 5, enters the independent supply channel 14 toward one end of the diaphragm 6. Next, the liquid proceeds horizontally along the extended direction of the diaphragm 6 to the other end of the diaphragm 6. The liquid then travels upward toward one end of the compression chamber 10. The liquid proceeds horizontally along the extended direction of the compression chamber 10 toward the other end of the compression chamber 10. The liquid then slowly travels horizontally toward the lower side mainly proceeding to the ejection hole 8 opened to the lower surface.

Holes of the aperture plate 4*c*, including portions to become the diaphragms 6 (hereinafter also referred to as "hole to become diaphragm"), slightly overlap another compression chamber 10 connected from the same secondary manifold 5*b* in FIG. 3. An arrangement where holes of the aperture plate 4*c* including portions to become diaphragms 6 are located within the secondary manifold 5*b* in planar view is desirable, since the diaphragms 6 can be disposed with a higher concentration. However, this arrangement means that the entirety of holes to become diaphragms will be located at a thinner portion of the secondary manifold 5*b* as compared to other members. Accordingly, influence from the surroundings is more readily incurred. Situating each hole to become a diaphragm so as not to overlap in planar view a compression chamber 10 other than the compression chamber 10 to which this hole to become a diaphragm is directly connected, in this case, enables direct influence of vibrations from another compression chamber 10 located directly above to be harder to receive, even if the hole to become a diaphragm is located at a thin portion on the secondary manifold 5*b*. This sort of arrangement is particularly necessary in a case where there is only one plate between the plate where holes to become diaphragms are formed (if configured including multiple plates, the topmost plate) and the plate where holes to become compression chambers 10 are formed (if configured including multiple plates, the bottom most plate), so vibrations are readily transmitted. This arrangement is also particularly necessary in a case where the distance between the plate where holes to become diaphragms are formed and the plate where holes to become compression chambers 10 are formed is 200 μm or less, and more so if 100 μm or less. An arrangement with no overlapping can be achieved by, for example, setting the angle of holes to become diaphragms illustrated in FIG. 3 so as to be closer to the direction of following the latitudinal direction of the head body 2*a*, slightly reducing the length of the holes to become diaphragms at one end thereof, or the like.

The piezoelectric actuator substrate 21 has a laminated construction made from two units of the piezoelectric ceramic layer 21*a* and 21*b*, which are piezoelectric bodies. The piezoelectric ceramic layer 21*a* and 21*b* have a thickness of approximately 20 μm each. The thickness from the lower surface of the piezoelectric ceramic layer 21*a* of the piezoelectric actuator substrate 21 to the upper surface of the piezoelectric ceramic layer 21*b* is approximately 40 μm. Either layer of the piezoelectric ceramic layer 21*a* and 21*b* extend crossing over the multiple units of the compression chamber 10. The piezoelectric ceramic layer 21*a* and 21*b* are made from ceramic materials such as lead zirconate titanate (PZT) having ferroelectric properties.

The piezoelectric actuator substrate 21 includes the common electrode 24 made from metallic materials such as Ag—Pd and the independent electrode 25 made from metallic materials such as Au. The independent electrode 25 includes the independent electrode body 25*a* disposed at a position facing the compression chamber 10 regarding the upper surface of the piezoelectric actuator substrate 21 as previously described, and the lead-out electrode 25*b* led out from there. The connecting electrode 26 is formed in the portion of the end of the lead-out electrode 25*b* led out away from the region facing the compression chamber 10. The connecting electrode 26 is made from a silver and palladium alloy including glass frit, for example, and formed convexly with a thickness of approximately 15 μm. The connecting electrode 26 is electrically connected to an electrode provisioned on the signal transmission unit 92. Details will be described later, but drive signals are supplied to the independent electrode 25 from the control unit 100 through the signal transmission unit 92. The drive signals are supplied at regular cycles synchronized with the conveyance speed of the printing paper P.

The common electrode 24 is formed across nearly the entire surface toward the surface on a region between the piezoelectric ceramic layer 21*a* and the piezoelectric ceramic layer 21*b*. That is to say, the common electrode 24 extends so as to cover all units of the compression chamber 10 within a range facing the piezoelectric actuator substrate 21. The thickness of the common electrode 24 is approximately 2 μm. The common electrode 24 is grounded and holds a ground voltage connecting to the common-electrode surface electrode 28, which is formed at a position avoiding an electrode group made from units of the independent electrode 25 on the piezoelectric ceramic layer 21*b*, via the via hole formed to the piezoelectric ceramic layer 21*b*. The common-electrode surface electrode 28 is connected to a different electrode on the signal transmission unit 92 similar to the great number of the independent electrodes 25.

A predetermined drive signal is selectively supplied to the independent electrode 25, which changes the volume in the compression chamber 10 corresponding to this independent electrode 25, and applies pressure to the liquid in the compression chamber 10, which will be described later. As a result, droplets are ejected from the corresponding liquid ejection hole 8 through the independent channel 12. That is to say, the portion regarding the piezoelectric actuator substrate 21 facing each compression chamber 10 corresponds to an individual displacing element 30 corresponding to each compression chamber 10 and liquid ejection hole 8. That is to say, the displacing element 30, which is the piezoelectric actuator functioning as a unit structure constructed as illustrated in FIG. 5 within the laminated body made from the two units of the piezoelectric ceramic layer 21*a* and 21*b*, is made for each compression chamber 10 by the vibrating plate 21*a* positioned directly above the compression chamber 10, the common electrode 24, the piezoelectric ceramic layer 21*b*, and the independent electrode 25. Multiple units of the displacing element 30, which functions as a compressing member, are included on the piezoelectric actuator substrate 21. According to the present embodiment, the amount of liquid ejected from the liquid ejection hole 8 by one ejecting operation is approximately 1.5 to 4.5 pl (picoliters).

The multiple units of the independent electrode 25 are each independently electrically connected to the control unit 100 via the signal transmission unit 92 and a wiring, so that the potential thereof can be individually controlled. When independent electrode 25 is given a different potential than the common electrode 24, and an electric field is applied to the piezoelectric ceramic layer 21*b* in the direction of polarization, the to which this electric field is applied functions as active unit that strains due to the piezoelectric effect. When the independent electrode 25 is set by the control unit 100 to a predetermined voltage that is either positive or negative in correspondence with the common electrode 24 so that the electric field and polarization are in the same direction in this configuration, the portion sandwiched in the electrodes of the piezoelectric ceramic layer 21*b* (active unit) shrinks in the planar direction. Conversely, the inactive layers of the piezoelectric ceramic layer 21*a* are not affected by the electric field, and so attempt to regulate the displacement of the active unit without voluntary shrinkage. As a result, there is a difference in strain toward the direction of polarization between the piezoelectric ceramic layer 21*b* and the piezoelectric ceramic layer 21*a*, which causes the piezoelectric ceramic layer 21*b* to be displaced so as to convex toward the compression chamber 10 (unimorph displacement).

The actual drive process according to the present embodiment sets the independent electrode 25 to a voltage higher than (hereafter, high voltage) the common electrode 24 beforehand, temporarily sets the independent electrode 25 to the same voltage (hereafter, low voltage) as the common electrode 24 every time there is a ejection request, and afterwards resets the independent electrode 25 to the high voltage at a predetermined timing. As a result, the piezoelectric ceramic layer 21*a* and the piezoelectric ceramic layer 21*b* return to their original form at the timing when independent electrode 25 is at the low voltage, and the volume of the compression chamber 10 increases in comparison to the initial state (when voltage of both electrodes is different). At this time, negative pressure is created in the compression chamber 10 suctioning liquid into the compression chamber 10 from the manifold 5. The piezoelectric ceramic layer 21*a* and 21*b* displace convexly toward the compression chamber 10 at the timing when the independent electrode 25 is again at the high voltage, which causes the pressure in the compression chamber 10 to change to positive pressure due to the reduction in volume in the compression chamber 10. This increases the stress of the liquid, causing the droplet to be ejected. That is to say, a drive signal including pulse in which the high voltage is the reference is supplied to the independent electrode 25 in order to eject the droplet. The ideal pulse width is the AL (Acoustic Length), which is the length of time for the compression wave to propagate from the diaphragm 6 to the ejection hole 8. As a result, the two stresses are combined when the state inside the compression chamber 10 changes from negative pressure to positive pressure, in which a stronger stress causes the droplet to be ejected.

Gradation printing is performed by a gradation expression of the droplet amount (volume) adjusted by the number of droplets consecutively ejected from the ejection hole 8, that is to say, the droplet ejection count. For this reason, the number of droplets to be ejected corresponding to the specified gradation expression are consecutively ejected from the ejection hole 8 corresponding to the specified dot region. It is generally preferable for the intervals between pulses supplied to eject the droplets, when consecutively eject droplets in this way, to be the AL. As a result, the cycles of the decaying stress wave generated by the previous ejection of droplets and the stress wave generated by the following ejection of droplets match, and so the stress waves superimpose to amplify the stress for ejecting droplets. The speed of droplets ejected afterwards may be assumed to increase, which is preferable since points of impact regarding multiple droplets become closer.

While the displacing element 30 using piezoelectric deformation has been illustrated as a compressing member, the present embodiment is not restricted to this. Any other thing which can change the volume of the compression chamber 10, i.e., can pressurize liquid within the compression chamber 10 will suffice. For example, arrangements where liquid within the compression chamber 10 is heated and boiled to generate pressure, or arrangements using MEMS (Micro Electro Mechanical Systems) may be used.

Figure 7:
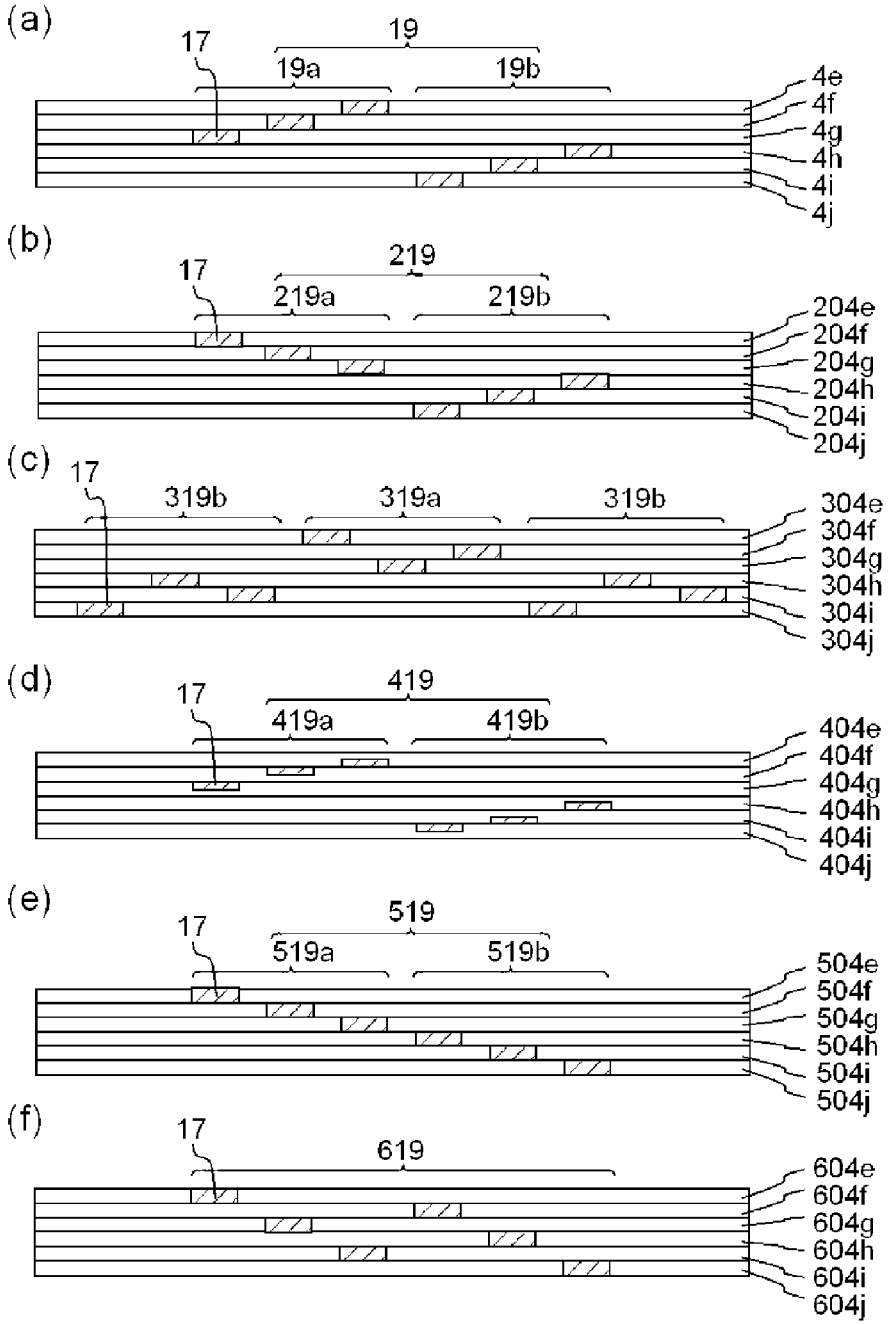
FIG. 7(*a*) is a longitudinal-section view of a manifold taken along line X-X on the liquid ejecting head in FIG. 2, and FIGS. (*b*) to (*f*) are longitudinal-section views of manifolds of other liquid ejecting heads, taken at the same portion.

Now, the placement of supporting members 17 in the liquid ejecting head 2 will be described in further detail. FIG. 7(*a*) is a longitudinal-section view of a secondary manifold 5*b* of the liquid ejecting head 2, taken along line X-X in FIG. 6. The left side of FIG. 7(*a*) is the hole 5*a* side of the manifold, and the right side is the middle side of the secondary manifold 5*b*. That is to say, the flow of liquid in FIG. 7(*a*) is basically from the left to the right (this may change depending on the image to be printed, but this is to say that on average, the liquid flows toward the middle of the secondary manifold 5*b*). The fluid channel member 4 of the liquid ejecting head 2 has a structure where multiple secondary manifolds 5*b* are partitioned by partitions 15. Holes to become secondary manifolds 5*b* and partitioning portions to become partitions 15 are formed to the manifold plates 4*e* through 4*j* when laminating the plates 4*a* through 4*k* so as to fabricate the fluid channel member 4. Looking at the configuration of the channels alone, it can be seen that the partitioning portions are not connected to their surroundings. Accordingly, the partitioning portions cannot be held in the state after having formed the holes to become secondary manifolds 5*b*. To this end, the supporting members 17 are provisioned to connect the partitioning portions and manifold plates 4*e* through 4*j*, and the partitioning portions one to another. It is difficult to precisely fabricate secondary manifolds 5*b* partitioned by partitions 15 which are long in one direction, even if not a structure as that of the present embodiment where the partitioning portions cannot be held without supporting members 17. However, provisioning the supporting members 17 allows the partitioning portions to become partitions 15 to be precisely positioned.

The supporting members 17 obstruct the flow of liquid within the secondary manifolds 5*b*, so a placement taking into consideration the flow of liquid to reduce the influence thereof is desired. Specifically, the supporting members 17 located at the upper half side in the height direction of laminating of the secondary manifolds 5*b*, and the supporting members 17 located at the lower half, are located divided in the length direction of the secondary manifolds 5*b*. In the present embodiment, the supporting members 17 are disposed having been divided into an upper supporting member group 19*a* and a lower supporting member group 19*b*. First through third supporting members 17 from above, which the first through third manifold plates 4*e* through 4*g* from above have, are arrayed in the upper supporting member group 19*a*. Fourth through sixth supporting members 17 from above, which the fourth through sixth manifold plates 4*h* through 4*j* from above have, are arrayed in the lower supporting member group 19*b*. The thicknesses of the manifold plates 4*e* through 4*g* are all the same in the present embodiment, but even in a case where the thicknesses are different, the supporting members 17 may be divided depending on which of the upper supporting member group 19*a* and lower supporting member group 19*b* the supporting members 17 belong to depending on the height in the laminating direction. The supporting members 17 divided thus are separated in the length direction of the secondary manifolds 5*b*. For example, in the event that manifold plates of respective thicknesses of 100 μm, 100 μm, 50 μm, 100 μm, and 150 μm from above are laminated, the upper three layers of the upper half which are 250 μm worth can be taken as the upper supporting member group, and the lower two layers of the lower half which are 250 μm worth can be taken as the lower supporting member group. The manifold plates are thus divided, and supporting members 17 are disposed accordingly.

Also, in a case where the supporting members 17 are half-etched or the like, and the height of the supporting members 17 and the manifold plates 4*e* through 4*j* are not the same, these can be divided into belonging to the upper supporting member group 19*a* or lower supporting member group 19*b* according to the height of the supporting members 17 in the secondary manifold 5*b*, and the supporting members 17 placed accordingly, which will be described later. If there is a supporting member 17 existing at the middle in the laminating direction, this supporting member 17 may be classified into either of the upper supporting member group 19*a* and lower supporting member group 19*b*. A more preferable idea is that if the center of gravity of supporting members 17 located at the middle in the laminating direction is closer to the top surface of the secondary manifold 5*b*, these belong to the upper supporting member group 19*a*, and if closer to the bottom surface, to the lower supporting member group 19*b*. An arrangement in which the thickness of the thickest manifold plate is thinner than ⅓ the thickness of the secondary manifold 5*b* enables the height of the channel remaining as the portion where liquid flows to be higher, thus reducing channel resistance.

The manifold plates are disposed divided into the upper supporting member group 19*a* and lower supporting member group 19*b* in the present embodiment. Further, the manifold plates 4*e* and 4*j* including the supporting members 17 which are the third and fourth from the left, adjacent across the boundary between these groups, are not laminated directly on each other, and other manifold plates 4*f* through 4*i* are laminated in between these. Accordingly, the liquid flows through the lower half of the secondary manifold 5*b* where there is the upper supporting member group 19*a,* and through the upper half of the secondary manifold 5*b* where the lower supporting member group 19*b* is. Moreover, the supporting members 17 adjacent across this boundary are located distanced one from another in the laminating direction at this boundary. Accordingly, the liquid smoothly flows between the supporting members 17 from above to below or from below to above, so the channel resistance of the secondary manifold 5*b* is reduced.

If the channel resistance of the secondary manifold 5*b* is small, insufficient supply of liquid does not readily occur, enabling sable printing. Also, small channel resistance reduces the difference in pressure placed on the independent supply channel 14 in the length direction of the secondary manifold 5*b.* Consequently, difference in ejection properties such as ejection speed and ejection amount can be reduced over the length direction of the liquid ejecting head 2, and printing precision can be improved.

If the number of manifold plates is three or less, the influence of the manifold plate located at the middle in the laminating direction is great, which impedes with smooth flow of liquid. Accordingly, the number of manifold plates is preferably four or more. Arranging the manifold plates such that the boundary of the laminated manifold plates is located at the center portion of the secondary manifold 5*b* in the laminating direction enables a channel of half the height of the secondary manifold 5*b* to be secured at both the upper supporting member group 19*a* and the lower supporting member group 19*b.*

When two supporting members 17 adjacent across the boundary between the upper supporting member group 19*a* and lower supporting member group 19*b* are distanced from one another by a distance equivalent to half or more the height of the secondary manifold 5*b* in the laminating direction, this means that a channel without supporting members 17, having approximately half the height of the secondary manifold 5*b,* is continuously secured over the entire supporting member group 19. This makes the flow of liquid even smoother, and channel resistance can be reduced even more. Note that the distance between supporting members 17 in the laminating direction is, more precisely, the distance in the laminating distance between the lower edge of the supporting member 17 located at the upper side and the upper edge of the supporting member 17 located at the lower side.

The manifold plates 4*e* through 4*g* having the supporting members 17 adjacent in the length direction of the secondary manifold 5*b* in the upper supporting member group 19*a* are directly laminated. This makes change in the height direction of the downstream side flow of the secondary manifold 5*b,* which is the primary liquid flow, to be smooth, so channel resistance can be made to be even smaller. This is true for the lower supporting member group 19*b* as well. Note that the expression "directly laminated" here refers to the relationship of the manifold plates 4*e* through 4*j,* and does not mean that no adhesive layers are introduced therebetween.

In light of the above, the supporting members 17 may be arrayed in the order of third from the top, second, first, sixth, fifth, and fourth, in order from one side in the length direction of the secondary manifold 5*b,* as illustrated in FIG. 7(*a*). Generally, at the upper supporting member group 19*a,* the supporting members 17 may be disposed such that the height increases in the direction toward the center of the supporting member group 19, and at the lower supporting member group 19*b,* the supporting members 17 may be disposed such that the height decreases in the direction toward the center of the supporting member group 19.

The supporting members 17 connected to one partitioning portion at the manifold plates 4*e* through 4*j* are connected at different positions. This makes it more difficult for bending to occur at the partitioning portions in fabrication process, and channel precision does not readily deteriorate. To this end, the manifold plates 4*e* through 4*j* where the supporting members 17 are connected at the same position are made to differ among adjacent partitions 15. Specifically, if the placement of supporting members 17 in one secondary manifold 5*b* is in the order of third from the top, second, first, sixth, fifth, and fourth, for example, the placement of supporting members 17 in an adjacent secondary manifold 5*b* may be made to be in an inverse order, which is in the order of fourth from the top, fifth, sixth, first, second, and third.

The supporting members 17 adjacent in the length direction of the secondary manifold 5*b* may partially overlap each other in the laminating direction. However, positioning the supporting members 17 away from each other realizes a smoother flow of liquid. The greater the distance in the length direction of the secondary manifold 5*b* between the supporting members 17 is, the smoother then flow is. However, if the spacings are too great, the distance between the supporting members 17 connected to one partitioning portion also becomes too great, and the effects of holding position may become insufficient. Placement of the supporting members 17 as described above is more effective when the distances between the supporting members 17 in a secondary manifold 5*b* are fairly close. Specifically, this is effective in a case where the distance between the supporting members 17 is equivalent to 0.01 seconds or less at the flow speed of the liquid in the secondary manifold 5*b.* In a case where the flow speed of a liquid with viscosity of around 200 mPa·s or less is 0.2 m/s in the secondary manifold 5*b* when printing such that the amount of ejection is greatest, a placement within 0.01 seconds at this speed, e.g., 2 mm (=0.2 *[m/s]*×0.01 [s]) is particularly effective. Placing the supporting members 17 further away gradually reduces the influence in the originating direction of the flow from the supporting members 17 based on their positions in the laminating direction. The reason why the supporting member group 19 is located as a single group, is that in a channel structure such as with the present embodiment where the edges of partitioning portions to become partitions 15 are not connected to the manifold plates 4*e* through 4*j,* the edge portions readily bend, or even if they do not bend the positional precision thereof readily deteriorates. Provisioning supporting members 17 at positions near the edges of the manifold plates 4*e* through 4*j* enables the positional precision of the ends to be raised. Also, the length of the supporting members 17 closer to the end in the length direction of the secondary manifold 5*b* may be made to be smaller than the width of the supporting members 17 at other portions. Thus, supporting members 17 can be provisioned even closer to the end.

Note that, conversely, distances between supporting member groups 19 are preferably 0.01 seconds or greater. Placement in a case of situating the supporting member groups 19 in closer proximity will be described later.

FIG. 7(*b*) through (*d*) illustrate other placements of supporting members 17 in the liquid ejecting head 2 according to the present embodiment. Herein, the basic structure of the liquid ejecting head 2 is the same as that illustrated in FIGS. 2 through 6, except for the placement of the supporting members 17. In each drawing, the fluid basically flows from the left to the right.

In FIG. 7(*b*), supporting members 17 are disposed in the order of first from the top, second, third, sixth, fifth, and fourth, in the direction of flow of the liquid. In general terms, the supporting members 17 belonging to an upper supporting member group 219*a* are disposed such that the distance from the plate 4*d* which is the top surface of the secondary manifold 5*b* increases in the direction of flow of the liquid, and the supporting members 17 belonging to a lower supporting member group 219*b* are disposed such that the distance from the plate 4*k* which is the bottom surface of the secondary manifold 5*b* increases in the direction of flow of the liquid. This placement can reduce the risk of air bubbles, which may be included in the fluid, from becoming caught at places where the distance between the supporting members 17 and the top surface or bottom surface gradually becomes smaller, obstructing the flow of the fluid.

In FIG. 7(*c*), an upper supporting member group 319*a* and lower supporting member group 319*b* are alternately disposed in close proximity. The term closer proximity here means within around 0.01 seconds of flow of the liquid. In such a placement in close proximity, two supporting members 17 adjacent across the boundary of the upper supporting member group 319*a* and lower supporting member group 319*b* are distanced from each other in the laminating direction, at all such boundaries. Thus, the liquid flows smoothly from the upper side to the lower side or from the lower side to the upper side, passing between the supporting members 17 at the boundaries, so the flow resistance of the secondary manifold 5*b* can be reduced. In FIG. 7(*c*), at the upper supporting member group 319*a*, supporting members 17 are disposed in the order of first from the top, third, and second, in the direction of flow of the liquid, and at the lower supporting member group 319*a*, supporting members 17 are disposed in the order of sixth from the top, fourth, and fifth, in the direction of flow of the liquid. This arrangement secures half the height of the secondary manifold 5*b* between the two supporting members 17 disposed across the boundary between the upper supporting member group 319*a* and lower supporting member group 319*b*, so the flow of liquid can be made smooth.

The placement of supporting members 17 illustrated in FIG. 7(*d*) is the same as that illustrated in FIG. 7(*a*), but the thickness of the supporting members 17 is thinner than the manifold plates 404*e* through 404*j* which have the supporting members 17. Accordingly, channel resistance can be reduced. There is no need to make all supporting members 17 thin, but making all thin will reduce the channel resistance further. In order to make the supporting members 17 thinner, half etching may be performed at the time of etching holes to become the secondary manifolds 5*b*.

Which portions to leave in the thickness direction of the manifold plates 404*e* through 404*j* when making the supporting members 17 thinner follows the idea described next. First, the upper side of supporting members 17 belonging to an upper supporting member group 519*a* is left (that is to say, so that the lower ends of the supporting members 17 are located above the bottom surface of the manifold plates 404*e* through 404*g*). Also, the lower side of supporting members 17 belonging to a lower supporting member group 519*b* is left (that is to say, so that the upper ends of the supporting members 17 are located below the top surface of the manifold plates 404*h* through 404*j*). Thus, the height of the portion where the fluid primarily passes through can be increased, so channel resistance can be further reduced.

Further, the following point is preferably taken into consideration. Channels connected to ejection holes 8 are formed on the top surface of the secondary manifold 5*b*. Accordingly, the lower side of the supporting member 17 on the manifold plate 404*e* which is laminated at the top of the manifold plates 404*e* through 404*j* is preferably left, to stabilize the flow around the top surface at this portion. Also, the bottom surface of the secondary manifold 5*b* may be formed as a deformable damper which changes the volume of the secondary manifold 5*b*. In this case, the upper side of the supporting member 17 of the manifold plate 404*j* located at the bottom of the manifold plates 404*e* through 404*j* is preferably left, so as to prevent suppressing deformation of the damper.

Now, a liquid ejecting head according to another embodiment of the present invention will be further described here. The basic structure of this liquid ejecting head is basically the same as the liquid ejecting head 2 illustrated in FIGS. 2 through 5, but the way in which the manifold 5 is partitioned by partitions 15 is different. Unlike the manifold plates 4*e* through 4*j*, the manifold 5 according to the present embodiment is partitioned by partitions 15 to the end of the manifold plate.

Figure 8:
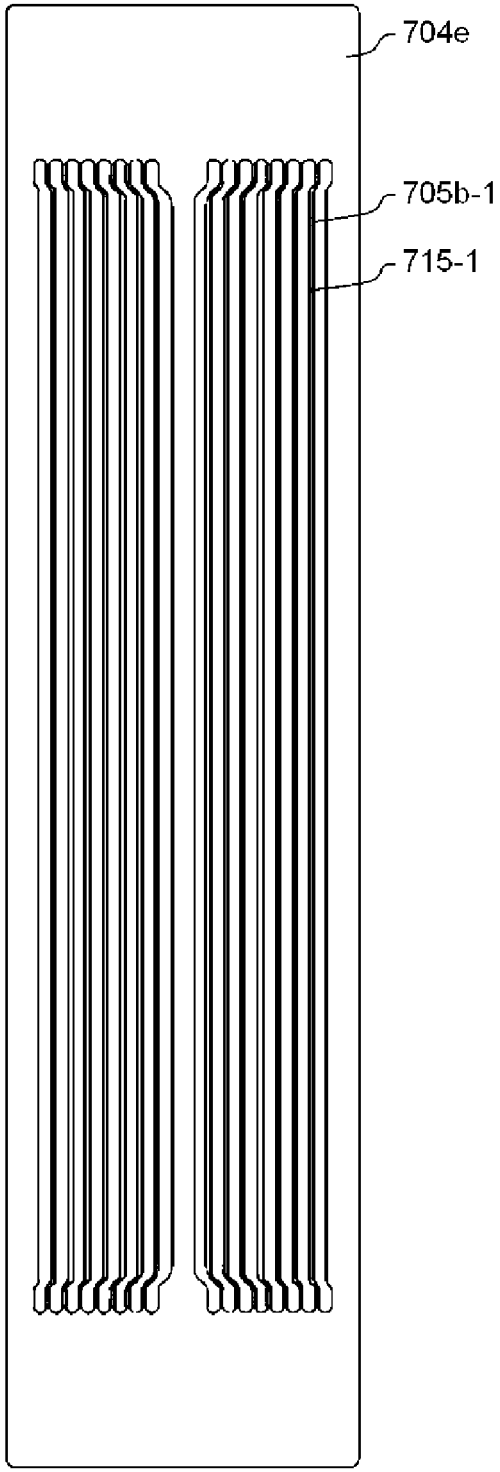
FIG. 8 is a plan view of a manifold plate used in a liquid ejecting head of another embodiment of the present invention.

FIG. 8 is a plan view of a manifold plate 704*e* used in the liquid ejecting head according to the present embodiment. The manifold plate 704*e* has multiple holes 705*b*-1 to become secondary manifolds 5*b* opened therein. The holes 705*b*-1 are holes which are long in one direction and completely independent. Between the holes 705*b*-1 are completely partitioned by portions 715-1 to become partitions of the manifold plate 704*e*. Note that the manifold plate 2704*e* also has opened therein small holes to become descenders and so forth, besides the holes 705*b*-1 to become secondary manifolds, but these are omitted from illustration.

The manifold plate 704*e* is used instead of the manifold plate 4*e* in the liquid ejecting head 2 illustrated in FIGS. 2 through 5. In this structure, the portions 715-1 to become partitions on the manifold plate 704*e* are connected to the perimeter portion of the manifold plate 704*e*, so there is no need to provision supporting members to hold partitions 15. Provisioning supporting portions within the secondary manifold 5*b* will increase the channel resistance of the secondary manifold 5*b* and the flow of liquid will be reduced. Also, liquid ejecting elements connected from portions where the secondary manifold 5*b* has supporting members differ in shape in comparison with other portions due to the supporting members, so there is the risk of difference in ejection properties as compared to the other liquid ejecting elements. Accordingly, these points can be improved by doing away with supporting members.

From the above perspective, the fewer the number of supporting members the better, so an arrangement may be made where only a part of the manifold plates are completely partitioned by portions to become partitions. Still, an arrangement where all manifold plates are completely partitioned by portions to become partitions, without supporting members provisioned, is more preferable. Thus, a range where manifold plates are laminated, or at the manifold plate in a case where there is only one manifold plate, the manifold 5 is completely partitioned by partitions 15 from one end to the other.

However, the portions to become partitions are slender in shape, so there is the risk that there may be lateral flexing at the time of laminating plates, resulting in the width of secondary manifolds 5*b* being changed, and ejection properties varying. Accordingly, supporting members may be provisioned to hold the positions of portions to become partitions. Even so, both ends of the portions to become partitions are connected to the plate. Accordingly, the number of supporting members can be reduced and spacings therebetween can be made wider, so the above-described effects can be obtained.

From the end of the multiple secondary manifolds 5*b* to the hole 5*a* leading to the outside may remain connected, at a range where manifold plates are laminated, or secondary manifolds 5*b* at the manifold plate in a case where there is only one manifold plate, in a state of the multiple secondary manifolds 5*b* partitioned by the partitions 15. Alternatively, the secondary manifolds 5*b* may be connected into one on the topmost manifold plate, or may be connected into one at any one plate before reaching a compression chamber surface 4-2. This is preferable since the channel resistance is smaller at the connected portion, and the flow amount can be made to be greater. Connecting into one on the topmost manifold plate is preferable with regard to the point that the flow amount can be made to be greater. Also, reducing the number of holes 5*a* at the compression chamber surface 4-2 is preferable since defective external connections occur less readily.

The portions 715-1 to become partitions may be connected to the surrounding plate in order to hold the portions 715-1 to become partitions in a plate by the above arrangement. Alternatively, just one end of both ends of the portions 715-1 to become partitions may be connected. In this case, the sides to be connected may all be arrayed at the same side, the connected sides may alternate, or yet another arrangement may be employed. Further, an arrangement may be made where both ends are connected but the ends are half-etched or the like, so as to be partially connected in the thickness direction and connected with a hole 705*b*-1 to become another secondary manifold, at the remaining portions. These arrangements enable liquids to travel between secondary manifolds at heightwise positions of the secondary manifolds 5*b*. Accordingly, in cases where there is difference in ejection amount among secondary manifolds 5*b*, causing difference in the amount of flow, this difference can be resolved more effectively as compared with cases where the secondary manifolds 5*b* are connected partway along a hole 5*a* to the outside. The portions 715-1 to become partitions are preferably connected to the perimeters of the manifold plates, to reduce positional shift of the portions 715-1 to become partitions when laminating.

Also, in a case where the hole 5*a* of the fluid channel member 4 is connected to a reservoir to supply liquid from around the middle of the fluid channel member 4 via the channel, the channel is preferably short. Connecting to the hole 5*a* from the middle of the fluid channel member 4 will result in supply of liquid being somewhat greater at the port of the hole 5*a* closer to the middle of the fluid channel member 4, i.e., closer to the middle in the latitudinal direction, as compared to the outer sides in the latitudinal direction. This can be cancelled out and supply be made uniform by increasing the channel resistance of secondary manifolds 5*b* closer to the middle in the latitudinal direction. This can be realized by bending the secondary manifolds 5*b* in the plane direction at portions of the secondary manifolds 5*b* connecting to the compression chamber 10 from the hole 5*a*, as illustrated in FIG. 8. The closer to the middle in the latitudinal direction, the greater the degree of bending the secondary manifolds 5*b* may be.

The liquid ejecting head 2 is fabricated in the following manner, for example. A tape made from piezoelectric ceramic powder and an organic composition is formed by a general tape forming process such as roll coating or slit coating to fabricate multiple green sheets which become the piezoelectric ceramic layer 21*a* and 21*b* after firing. An electrode paste, which becomes the common electrode 24 on this surface, is formed on a portion of the green sheet by printing or similar. A via hole may be formed on a portion of the green sheet as necessary, and a via conductor is filled in this interior.

The green sheets are then laminated to fabricate a laminated body, pressurized, and then the pressurized laminated body is fired under atmospheric conditions with a high concentration of oxygen. Subsequently, the independent electrode 25 is printed onto the surface of the fired product using an organometallic paste, and then fired. Thereafter, an Ag paste is used to print the connecting electrode 26, which is fired, thus fabricating the piezoelectric actuator substrate 21.

Next, the fluid channel member 4 is fabricated by laminating the plates 4*a* through 4*l* obtained by the rolling method or similar with an adhesive. Holes which become the manifold 5, the independent supply channel 14, the compression chamber 10, and the descender are etched into the plates 4*a* through 4*l* with predetermined forms.

These plates 4*a* through 4*l* are preferably formed by at least one type of metal selected from a group of Fe—Cr metals, Fe—Ni metals, and Wc-TiC metals. Fe—Cr metals are particularly desirable when the liquid to be used is ink, as these metals have superior corrosion resistances against ink.

The piezoelectric actuator substrate 21 and the fluid channel member 4 may be laminated using an adhesive, for example. The adhesive used may be a well-known material, but at least one type of thermosetting resin adhesive selected from a group of epoxy resin with a thermosetting temperature of between 100 and 150° C., a phenol resin, and a polyphenylene ether resin should be used to prevent any effect on the piezoelectric actuator substrate 21 and fluid channel member 4. By heating this kind of adhesive to the thermosetting temperature, the piezoelectric actuator substrate 21 and the fluid channel member 4 may be bonded by heat. After joining, voltage is applied at the common electrode 24 and independent electrode 25 so as to polarize the piezoelectric ceramic layer 21*b* in the thickness direction.

Next, a silver paste is supplied to the connecting electrode 26 to electrically connect the piezoelectric actuator substrate 21 to the control unit 100, an FPC, which functions as the signal transmission unit 92 to which a driver IC has been previously implemented, is installed, and then heat is applied to the silver paste to harden and create the electrical connection. The implementation of the driver IC involves electrically connecting a flip chip to the FPC using solder, and then supplying and hardening a protective resin around the solder.

Next, a reservoir is attached as necessary to supply liquid from the hole 5*a*, and after screwing on a metal housing, the bonded portions are sealed with a sealant, and thus the liquid ejecting head 2 may be fabricated.

Reference Signs List

1 printer
2 liquid ejecting head
2*a* head body
4 fluid channel member
4*a* through 4*m*, 704*e* plates (of the fluid channel member)
4-1 ejection hole surface
4-2 compression chamber surface
5 manifold (common channel)
5*a* hole (of the manifold)
5*b* secondary manifold

**705*b*-1** hole to become a secondary manifold
6 diaphragm
8 ejection hole
9 ejection hole row
10 compression chamber
11 compression chamber row
12 independent channel
14 independent supply channel
15 partition
715-1 portion to become a partition
16 dummy compression chamber
21 piezoelectric actuator substrate
**21*a*** piezoelectric ceramic layer (vibration substrate)
**21*b*** piezoelectric ceramic layer
24 common electrode
25 independent electrode
**25*a*** independent electrode body
**25*b*** lead-out electrode
26 connecting electrode
28 common-electrode surface electrode
30 displacing element (compressing member)

What is claimed is:

1. A liquid ejecting head, comprising:
a fluid channel member being elongated in a first direction, has a first end and a second end opposite to each other in the first direction, and comprising:
a plurality of ejection holes;
a plurality of compression chambers connected to the plurality of ejection holes, respectively; and
a manifold for supplying liquid to the plurality of compression chambers; and
a plurality of compressing members bonded to the fluid channel member, and contacting the respective compression chambers for changing the volume of the respective plurality of compression chambers,
wherein, in a planar view of the fluid channel member, the manifold comprises:
a length extending from a first end portion substantially adjacent to the first end to a second end portion substantially adjacent to the second end;
openings at the first and second end portions of the fluid channel member; and
a plurality of secondary manifolds divided by a plurality of partitions that are elongated in the first direction,
wherein the compression chambers connected to one of the secondary manifolds configure two compression chamber rows disposed along the secondary manifolds, and the compression chambers belonging to the two compression chamber rows do not overlap in the first direction with compression chambers belonging to compression chamber rows adjacent to the two compression chamber rows, and
wherein the partitions become increasingly longer the closer they are to the center portion of the manifold in a direction orthogonal to the first direction.

2. The liquid ejecting head according to claim 1, wherein
the fluid channel member is like a flat plate,
the plurality of compression chambers are opened to a principal surface at one side of the fluid channel member, and
the ejection holes connected to the compression chambers belonging to the two compression chamber rows are each disposed along the secondary manifolds and opened to another principal surface of the fluid channel member.

3. The liquid ejecting head according to claim 2, wherein
the fluid channel member is configured by laminating a plurality of plates, and
in one or a plurality of the plates in which holes to serve as the plurality of secondary manifolds are opened, adjacent secondary manifolds are completely partitioned at portions to become the one or more partitions of the one or plurality of plates.

4. The liquid ejecting head according to claim 2, wherein in the planar view of the fluid channel member, ejection holes connected to one of the secondary manifolds via the compression chambers are opened closer to the one of the secondary manifolds than ejection holes connected via the compression chambers to another of the secondary manifolds adjacent to the one of the secondary manifolds.

5. The liquid ejecting head according to claim 1, wherein in the planar view of the fluid channel member, a ratio of an area of a region where one of the compression chambers overlap the secondary manifold to an area of the one of the compression chambers is generally the same for each of the plurality of compression chambers.

6. The liquid ejecting head according to claim 1, wherein the width of the one or more partitions is smaller than the width of the secondary manifolds.

7. The liquid ejecting head according to claim 1, wherein
the one or more partitions are each configured by four or more manifold plates that are laminated consecutively,
each of the four or more manifold plates comprises:
a plurality of holes to become the plurality of secondary manifolds;
a partitioning portion to become the one or more partitions; and
a supporting member crossing holes to become a plurality of secondary manifolds elongated and having a length extending in a second direction perpendicular to the first direction in the planar view,
a supporting member group is disposed in each of the secondary manifolds in which a plurality of supporting members are arranged in the first direction, and
the supporting member group is arranged and divided along the first direction into:
an upper-side supporting member group located at a side above half the height of the secondary manifold in a third direction of the four or more manifold plates, the third direction perpendicular to the first and second directions; and
a lower-side supporting member group located at a side below half the height of the secondary manifold in the third direction, and manifold plates, which comprise two of the supporting members right across a boundary between the upper-side supporting member group and lower-side supporting member group in the first direction, are laminated with another one or more manifold plates therebetween.

8. The liquid ejecting head according to claim 7, wherein
two manifold plates, which comprise two of the supporting members belonging to the upper-side supporting member group and next to each other in the first direction, are directly laminated to each other, and
two manifold plates, which comprise two of the supporting members belonging to the lower-side supporting member group and next to each other in the first direction, are directly laminated to each other.

9. The liquid ejecting head according to claim 8, wherein
supporting members belonging to the upper-side supporting member group are disposed such that a distance from a top surface of one of the secondary manifolds increases in a direction in which the liquid flows along the first direction within the one of the secondary manifolds, and supporting members belonging to the lower-side supporting member group are disposed such that a distance from a bottom surface of the one of the secondary manifolds increases.

10. The liquid ejecting head according to claim 7, wherein the upper-side supporting member groups and the lower-side supporting member groups are alternately disposed in the first direction within the secondary manifold, and manifold pates, which comprise two of the supporting members right across all boundaries between all upper-side supporting member groups and lower-side supporting member groups, are laminated with another manifold plate therebetween.

11. The liquid ejecting head according to claim 7, wherein a distance in the third between the two supporting members right across the boundary between the upper-side supporting member group and the lower-side supporting member group is half or more of the height of the secondary manifold in the third direction.

12. The liquid ejecting head according to claim 7, wherein one or more channels connected to the plurality of ejection holes are provided on the top surface of one of the secondary manifolds, one or more supporting members belonging to the upper-side supporting member group, other than a supporting member located at the highest position in the third direction, are thinner than the manifold plates comprising the supporting members, and also the lower ends thereof are located above the bottom surface of the manifold plates, and one or more supporting members belonging to the lower-side supporting member group, and one or more supporting members located at the highest position in the third direction, are thinner than the manifold plates comprising these supporting members, and also the upper ends thereof are located below the top surface of the manifold plates.

13. The liquid ejecting head according to claim 7, wherein a channel connected to the plurality or ejection holes is formed on the top surface of the secondary manifold, and the bottom surface of the secondary manifold is formed as a deformable damper so as to change the volume of the manifold;

supporting members belonging to the upper-side supporting member group other than the supporting member located at the highest position in the third direction, and supporting members located at the lowest position in the third direction, are thinner than the manifold plates comprising the supporting members, and also the lower ends thereof are located above the bottom surface of the manifold plates; and supporting members belonging to the lower-side supporting member group other than the supporting member located at the lowest position in the third direction, and the supporting member located at the highest position in the third direction, are thinner than the manifold plates comprising the supporting members, and also the upper ends thereof are located below the top surface of the manifold plates.

14. The liquid ejecting head according to claim 1, wherein the compressing member is a displacement element: provided on a piezoelectric actuator substrate which is elongated in the first direction and in which the common electrode, the piezoelectric ceramic layer, and the independent electrode are laminated in this order; and comprising a common electrode, independent electrodes, and a piezoelectric ceramic layer sandwiched by the common electrode and independent electrodes, the compression chamber and the independent electrode have a diamond shape having a diagonal along the first direction, and the independent electrodes are disposed on a grid of rows and columns in the first direction and a direction orthogonal to the first direction.

15. The liquid ejecting head according to claim 14, wherein the piezoelectric actuator substrate is provisioned above the fluid channel member.

16. The liquid ejecting head according to claim 14, wherein the piezoelectric actuator substrate further comprises:

one or more common-electrode surface electrodes provided on the piezoelectric ceramic layer; and one or more via hole conductors provided within the piezoelectric ceramic layer and connecting the common-electrode surface electrodes and the common electrodes, in planar view of the fluid channel member, the fluid channel member comprises an even number of manifolds of the manifolds overlapping the piezoelectric actuator substrate, and the common-electrode surface electrodes and the via hole conductors are provided at a center portion of the even number of manifolds in a direction orthogonal to the first direction.

17. A recording device, comprising:

a liquid ejecting head according to claim 1;

a conveying unit configured to convey a recording medium in relation to the liquid ejecting head; and a control unit configured to control the plurality of compressing members.

18. A liquid ejecting head, comprising:

a fluid channel member being elongated in a first direction, has a first end and a second end opposite to each other in the first direction, and comprising:

a plurality of ejection holes;

a plurality of compression chambers connected to the plurality of ejection holes, respectively; and a manifold for supplying liquid to the plurality of compression chambers; and a plurality of compressing members bonded to the fluid channel member, and contacting the respective compression chambers for changing the volume of the respective plurality of compression chambers, wherein, in a planar view of the fluid channel member, the manifold comprises:

a length extending from a first end portion substantially adjacent to the first end to a second end portion substantially adjacent to the second end; and a plurality of secondary manifolds divided by one or more partitions that are elongated in the first direction, wherein the one or more partitions are each configured by four or more manifold plates that are laminated consecutively, each of the four or more manifold plates comprises:

a plurality of holes to become the plurality of secondary manifolds;

a partitioning portion to become the one or more partition; and a supporting member crossing holes to become a plurality of secondary manifolds elongated and having a length extending in a second direction perpendicular to the first direction in the planar view, a supporting member group is disposed in each of the secondary manifolds in which a plurality of supporting members are arranged in the first direction, and the supporting member group is arranged and divided along the first direction into:

an upper-side supporting member group located at a side above half the height of the secondary manifold in a third direction of the four or more manifold plates, the third direction perpendicular to the first and second directions; and a lower-side supporting member group located at a side below half the height of the secondary manifold in the third direction, and manifold plates, which comprise two of the supporting members right across a boundary between the upper-side supporting member group and lower-side supporting member group in the first direction, are laminated with another one or more manifold plates therebetween.

* * * * *